US008197021B2

(12) United States Patent
Aoki et al.

(10) Patent No.: US 8,197,021 B2
(45) **Date of Patent: *Jun. 12, 2012**

(54) RECORDING HEAD DRIVING METHOD AND RECORDING APPARATUS

(75) Inventors: Takatsuna Aoki, Yokohama (JP); Hiroshi Takabayashi, Atsugi (JP); Seiichiro Karita, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/296,081

(22) Filed: Nov. 14, 2011

(65) Prior Publication Data

US 2012/0062631 A1 Mar. 15, 2012

Related U.S. Application Data

(63) Continuation of application No. 12/101,647, filed on Apr. 11, 2008, now Pat. No. 8,075,101.

(30) Foreign Application Priority Data

Apr. 27, 2007 (JP) ..... 2007-118634

(51) Int. Cl.
*B41J 29/38* (2006.01)
*B41J 2/05* (2006.01)

(52) U.S. Cl. ..... 347/14; 347/57

(58) Field of Classification Search ..... 347/14, 347/57
See application file for complete search history.

(56) References Cited

U.S. PATENT DOCUMENTS

| | | | | |
|---|---|---|---|---|
| 5,714,989 | A * | 2/1998 | Wade | 347/14 |
| 6,474,772 | B1 * | 11/2002 | Kawamura et al. | 347/19 |
| 7,404,612 | B2 * | 7/2008 | Takamiya et al. | 347/11 |
| 7,673,961 | B2 * | 3/2010 | Shihoh et al. | 347/19 |
| 7,690,751 | B2 * | 4/2010 | Takabayashi et al. | 347/19 |
| 7,914,106 | B2 * | 3/2011 | Takabayashi et al. | 347/19 |
| 8,075,101 | B2 * | 12/2011 | Aoki et al. | 347/57 |

* cited by examiner

*Primary Examiner* — Omar Rojas
(74) *Attorney, Agent, or Firm* — Canon USA Inc. IP Division

(57) ABSTRACT

A recording head includes electrothermal transducers associated with temperature sensing elements. A method for driving the recording head includes supplying driving energy to the electrothermal transducer, and evaluating a temperature change in a temperature fall interval, occurring after supplying of driving energy to the electrothermal transducer, based on temperature information acquired from the temperature sensing element. The method further includes changing a setting value of the driving energy supplied to the electrothermal transducer, determining an energy value for driving the electrothermal transducer based on the evaluated temperature change and an energy value supplied to the electrothermal conversion element, and recording data on a recording medium by driving the electrothermal transducer according to the determined energy value.

7 Claims, 17 Drawing Sheets

RECORDING HEAD DRIVING METHOD AND RECORDING APPARATUS

CROSS-REFERENCE TO RELATED APPLICATIONS

This application is a continuation of U.S. patent application Ser. No. 12/101,647 filed Apr. 11, 2008, which claims priority from Japanese Patent Application No. 2007-118634 filed Apr. 27, 2007, all of which are hereby incorporated by reference herein their entirety.

BACKGROUND OF THE INVENTION

1. Field of the Invention

The present invention relates to a method for driving a recording head configured to discharge an ink droplet with an electrothermal transducer that can generate thermal energy, and also relates to a recording apparatus including the recording head.

2. Description of the Related Art

An inkjet recording apparatus is a non-impact recording apparatus that performs recording on a paper or another type of sheet with ink discharged from a recording head. The inkjet recording apparatus is capable of performing high-speed recording or using various recording media and is advantageous in noise reduction. Therefore, inkjet recording apparatuses are widely used for printers, wordprocessors, facsimiles, and copying machines.

As discussed in Japanese Patent Application Laid-Open No. 2005-161614, a conventional inkjet recording apparatus has the following structure.

FIG. 13 illustrates a perspective view of an inkjet recording apparatus M1000. FIG. 14 illustrates a perspective view of the interior of the inkjet recording apparatus M1000. The inkjet recording apparatus M1000 includes a feeding unit M3022 that feeds a recording sheet and a recording unit M3000 that performs a recording operation by discharging ink onto a supplied recording sheet. As illustrated in FIG. 13, the main body of the inkjet recording apparatus M1000 is covered with a casing M1005. The feeding unit M3022 includes feeding rollers (not illustrated) that feed a recording sheet to the recording unit M3000 according to a predetermined driving signal.

The recording unit M3000 includes a guide shaft M3020 fixed to a chassis M3019 (i.e., a base frame of the inkjet recording apparatus M1000) and a carriage M4001 supporting a recording head H1001 (refer to FIG. 15). The carriage M4001 can move forward and backward in parallel with the guide shaft M3020 (i.e., X direction in FIG. 14). Then, while the carriage M4001 performs a scanning operation relative to a recording sheet, the recording head H1001 discharges ink droplets from discharge ports (not illustrated) to perform recording.

FIG. 15 illustrates a perspective view of the recording head H1001 to be mounted on the carriage M4001 of the inkjet recording apparatus M1000, with discharge ports provided at a bottom side thereof. The recording head H1001 illustrated in FIG. 15 is configured to drive an electrothermal transducer (electrothermal conversion element, energy generation element) in accordance with an electric signal to cause film boiling in ink and thereby discharge an ink droplet.

The recording head H1001 includes a holder H1500 made of a resin material and a recording element substrate H1100 attached to a lower surface of the holder H1500 and having discharge ports (not illustrated) from which ink droplets can be discharged. The recording head H1001 includes an electric wiring board H1300 that supplies electric signals to the recording element substrate H1100. The holder H1500 has a configuration capable of holding a plurality of ink tanks (not illustrated) and is detachably engaged with the above-described carriage M4001 (refer to FIG. 14).

FIG. 16 is an exploded perspective view of the recording head H1001 illustrated in FIG. 15. A discharge port surface H1550, configured into a flat surface, is provided on the bottom of the holder H1500, as illustrated in FIG. 16. A supporting recess 1501, capable of accommodating the recording element substrate H1100, is formed on the discharge port surface H1550. A plurality of ink channels H1502, each supplying an ink from an ink tank (not illustrated) to the recording element substrate H1100, is opened to the supporting recess 1501.

The recording element substrate H1100 is made of a silicon-made substrate and is rectangular in external shape. A plurality of discharge port groups H1101, each group including a plurality of discharge ports, is provided on the recording element substrate H1100. The discharge port groups H1101 are arrayed at equal intervals in the scanning direction of the carriage M4001 (X direction in FIG. 15). Each discharge port group H1101 includes a plurality of discharge ports arrayed in a direction perpendicular to the scanning direction of the carriage M4001 (Y direction in FIG. 15) in a state where the recording head H1001 is assembled with the carriage M4001.

The electric wiring board H1300 is, for example, made of a tape automated bonding (TAB) film which is bendable. The electric wiring board H1300 has one end adhering to the bottom of the holder H1500 and the other end fixed to a side surface of the holder H1500. The electric wiring board H1300 includes an aperture H1301 that faces the bottom of the holder H1500 and a contact portion H1350 that contacts an external electric connector portion (not illustrated) at the other end. For example, the TAB film has a thickness of 0.12 mm.

Next, an example structure of the recording element substrate H1100 placed in the supporting recess H1501 is described in more detail below.

FIGS. 17A and 17B illustrate an example structure of discharge ports and a peripheral structure of the recording head H1001 illustrated in FIG. 15. FIG. 17A illustrates the bottom of the recording head H1001 that includes discharge ports, and FIG. 17B illustrates a cross-sectional view of the recording element substrate H1100 taken along a line 17B-17B of FIG. 17A.

FIG. 18 illustrates an enlarged cross-sectional view of the recording element substrate H1100. The recording element substrate H1100 has a laminated structure including an orifice plate H1115*a* including a plurality of discharge ports H1101*a* and a heater board H1115*b* including ink supply ports H1101*b*, as illustrated in FIG. 18. The orifice plate H1115*a*, which is made of a thin plate member, includes a total of six discharge port groups H1101 arrayed in a predetermined direction. Each discharge port group H1101 includes a plurality of discharge ports H1101*a* as illustrated in FIG. 17A. The number of the discharge port groups H1101 corresponds to the number of ink tanks (not illustrated) installable on the holder H1500 (refer to FIG. 16). Each discharge port group H1101 can discharge an ink supplied from a corresponding ink tank (not illustrated).

The ink supply port H1101*b* of the heater board H1115*b*, although not illustrated, can be formed as an elongated hole extending in parallel with the discharge port group H1101 illustrated in FIG. 17A. One ink supply port H1101*b* is formed for each discharge port group H1101 on the orifice plate H1115*a*, so that ink can be supplied to respective discharge ports H1101*a* of each discharge port group H1101.

Although not illustrated, a plurality of heat generating resistors (electrothermal conversion elements) is provided on a surface of the heater board H1115*b* to which the orifice plate H1115*a* adheres. The heat generating resistors, each serving as "energy generation element", are disposed at equal intervals at both sides of the ink supply port H1101*b*. Furthermore, electric wiring (not illustrated) is provided on the same surface of the heater board H1115*b*. The electric wiring supplies electric power to the above-described heat generating resistors. The wiring is connected to electrode pads (not illustrated) provided at both sides of the heater board H1115*b* in the longitudinal direction.

As illustrated in FIG. 17A, the supporting recess H1501 in which the recording element substrate H1100 can be disposed has a rectangular outer shape larger than that of the recording element substrate H1100. The supporting recess H1501 has a predetermined depth so that the recording element substrate H1100 and the electric wiring board H1300 are positioned on the same plane when the recording element substrate H1100 is placed in the supporting recess H1501 as illustrated in FIG. 17B. This plane can be referred to as "discharge port surface."

The recording element substrate H1100 is disposed and bonded approximately at the center of the supporting recess H1501, so that the ink supply port H1101*b* can communicate with the ink channel H1502 of the holder H1500.

When the recording element substrate H1100 is disposed in the supporting recess H1501, a groove H1503 (refer to FIG. 17B) is formed around the recording element substrate H1100. More specifically, the groove H1503 is positioned between an outer peripheral surface of the recording element substrate H1100 and an inner peripheral surface of the supporting recess H1501. The groove H1503 is sealed with first sealing members M1303*a* and second sealing members M1303*b*. The first sealing members M1303*a* are disposed along short sides of the recording element substrate H1100, and the second sealing members M1303*b* are disposed along long sides of the recording element substrate H1100.

A lead H1302 on the electric wiring board H1300 provides an electric connection between the recording element substrate H1100 and the electric wiring board H1300. The lead H1302 extends along each long side of the rectangular aperture H1301 formed on the electric wiring board H1300. Accordingly, the lead H1302 and the electrode pad (not illustrated) of the recording element substrate H1100 are electrically connected along the long side of the recording element substrate H1100. This electric connection can be realized by forming a bump on the electrode pad (not illustrated) of the heater board H1115*b* and mounting the lead H1302 using the TAB mounting method. The electric connecting portion (not illustrated) can be sealed with a sealing member.

According to the above-described recording head H1001, a heat generating resistor (not illustrated) of the recording element substrate H1100 is driven in response to an electric signal input via the contact portion H1350 of the electric wiring board H1300. Then, the recording head H1001 performs recording by discharging ink from the discharge port H1101*a*.

The minimum input energy required for generating bubbles in the ink (i.e., bubbling threshold energy) is not constant for each recording head because of differences in manufacturing processes of the heater board H1115*b* (which may have different dimensions in the electrothermal conversion member and the electric wiring).

Accordingly, if the energy applied from the inkjet recording apparatus is constant, following problems arise. For example, if the applied energy is excessively lower than the bubbling threshold energy, the ink does not bubble. On the other hand, if the applied energy is excessively higher than the bubbling threshold energy, an excessive load is applied to the electrothermal conversion member and the recording head may be damaged.

Hence, manufacturing processes of a conventional recording head include measuring the bubbling threshold energy for each recording head and classifying the recording head into one of a plurality of ranks according to the measured bubbling threshold energy. On the other hand, an inkjet recording apparatus identifies the rank of an associated recording head and adjusts a driving voltage or a driving pulse width for the recording head according to the rank.

Furthermore, to enable an inkjet recording apparatus to discriminate the rank of a recording head, a dedicated wiring is provided on a relay wiring substrate and a predetermined portion of the wiring is cut according to the rank so that the state of electric connection between the inkjet recording apparatus and the recording head can be changed.

Furthermore, a memory or a comparable storage element can be provided on a recording head. The storage element stores data relating to the rank of each recording head. The inkjet recording apparatus reads the data stored in the storage element of the recording head.

Similarly, an inkjet recording apparatus can identify characteristics that require changing of driving conditions, in addition to the bubbling threshold energy.

The above-described method enables an inkjet recording apparatus to identify driving conditions of a recording head. However, the following problems arise if the above-described method is employed.

First, a new process is required to inspect a printed material when each recording head is delivered from a factory and measure a minimum energy value to be input into a recording head. Furthermore, another process is required to store the information relating to a measured energy value into the storage element of the recording head. Accordingly, the throughput in the delivery process for a recording head (manufacturing process) deteriorates.

Furthermore, according to the recording head discrimination method that includes cutting a dedicated wiring according to a measured energy value, a special tool is required to cut the wiring. The work in the delivery process becomes troublesome due to cutting of the wiring.

SUMMARY OF THE INVENTION

Exemplary embodiments of the present invention are directed to an inkjet recording apparatus capable of stably discharging an ink droplet regardless of a change in characteristics of a recording head. Furthermore, exemplary embodiments of the present invention are directed to a method for controlling an inkjet recording apparatus.

According to an aspect of the present invention, a method is provided for driving a recording head including a plurality of electrothermal conversion elements associated with temperature sensing elements disposed above or below the electrothermal conversion elements. The method includes supplying driving energy to the electrothermal conversion element; acquiring temperature information from the temperature sensing element; evaluating a temperature change in a temperature fall interval, occurring after supplying of driving energy to the electrothermal transducer, based on the temperature information acquired from the temperature sensing element; changing a setting value of the driving energy supplied to the electrothermal transducer; determining an energy value for driving the electrothermal transducer based on the evaluated temperature change and an energy value supplied to the electrothermal transducer; and recording data on a recording medium by driving the electrothermal transducer according to the determined energy value.

According to another aspect of the present invention, a method is provided for driving a recording head including a plurality of electrothermal transducers associated with temperature sensing elements disposed above or below the electrothermal transducers. The method includes supplying driving energy to the electrothermal transducer, acquiring temperature information from the temperature sensing element; acquiring gradient change timing occurring in a normal discharge operation, in a temperature fall interval occurring after supplying of driving energy to the electrothermal transducer, based on the temperature information acquired from the temperature sensing element; evaluating a temperature change in the temperature fall interval based on temperature information obtained when a predetermined time has elapsed after the acquired change timing, and a temperature threshold; changing a setting value of the driving energy supplied to the electrothermal transducer; determining an energy value for driving the electrothermal transducer based on the evaluated temperature change and an energy value supplied to the electrothermal transducer; and recording data on a recording medium by driving the electrothermal transducer according to the determined energy value.

According to another aspect of the present invention, a method is provided for driving a recording head including a plurality of electrothermal transducers associated with temperature sensing elements disposed above or below the electrothermal transducers. The method includes supplying driving energy to the electrothermal transducer; acquiring temperature information from the temperature sensing element; acquiring gradient change timing occurring in a normal discharge operation, in a temperature fall interval occurring after supplying of driving energy to the electrothermal transducer, based on the temperature information acquired from the temperature sensing element; evaluating a temperature change in the temperature fall interval based on an integrated value of temperature information during a predetermined period of time after the acquired change timing, and a temperature threshold; changing a setting value of the driving energy supplied to the electrothermal transducer; determining an energy value for driving the electrothermal transducer based on the evaluated temperature change and an energy value supplied to the electrothermal transducer; and recording data on a recording medium by driving the electrothermal transducer according to the determined energy value.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments and features of the invention and, together with the description, serve to explain at least some of the principles of the invention.

DETAILED DESCRIPTION OF THE EMBODIMENTS

Figure 1A:
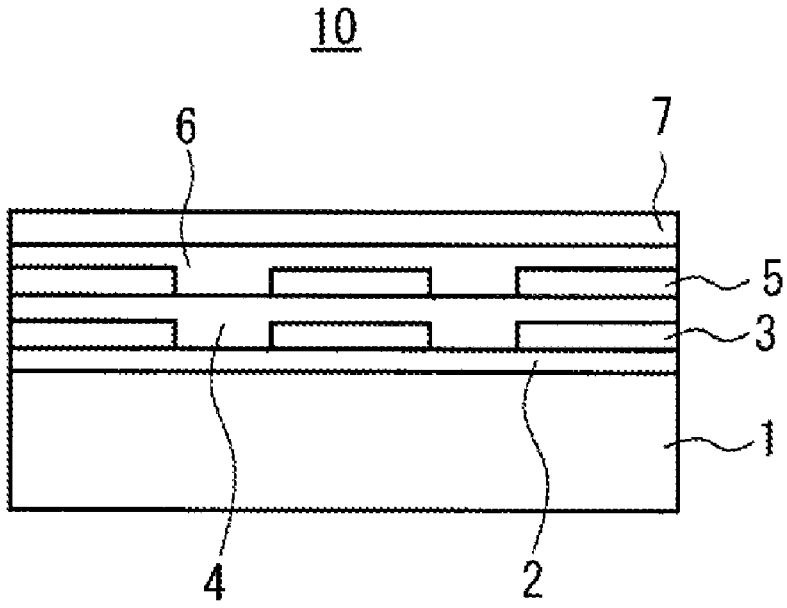
FIGS. 1A and 1B illustrate a recording head according to a first exemplary embodiment of the present invention.

The following description of exemplary embodiments is illustrative in nature and is in no way intended to limit the invention, its application, or uses. It is noted that throughout the specification, similar reference numerals and letters refer to similar items in the following figures, and thus, once an item is described in one figure, it may not be discussed for following figures. Exemplary embodiments will be described in detail below with reference to the drawings.

First Exemplary Embodiment

Figure 1B:
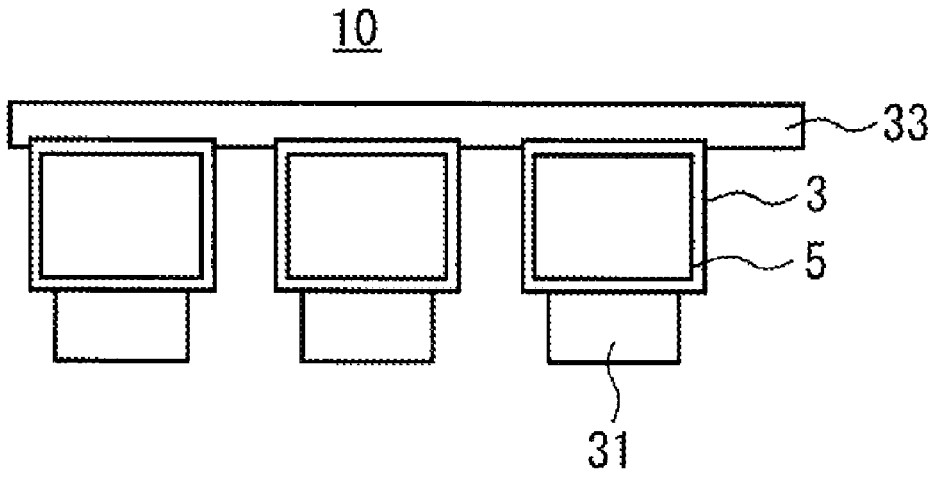

FIGS. 1A and 1B illustrate a recording head 10 according to a first exemplary embodiment of the present invention. FIG. 1A is a cross-sectional view of the recording head 10 although discharge nozzles are omitted. FIG. 1B is a plan view of the recording head 10 although discharge nozzles are omitted. In the recording head 10 illustrated in FIG. 1B, a square temperature sensing element 3 is disposed right below a heater 5.

The recording head 10 includes a Si substrate 1, a thermal accumulation layer 2, the temperature sensing element 3, a wiring 31, a wiring 33, an interlayer insulating film 4, the heater (electrothermal conversion element) 5, a passivation film 6, and an cavitation-resistant film 7.

The temperature sensing element 3 is formed on the Si substrate 1 via the thermal accumulation layer 2 (e.g., thermal oxide film SiO2). The temperature sensing element 3 is made of a thin-film resistor (e.g., Al, Pt, Ti, TiN, TiSi, Ta, TaN, TaSiN, TaCr, Cr, CrSiN, or W). The connection wiring formed on the Si substrate 1 includes the wirings 31 and 33 (for example, made of Al), the heater 5, and Al wiring connecting a control circuit formed on the Si substrate.

The heater (electrothermal transducer, electrothermal conversion element) 5 made of TaSiN, the passivation film 6 made of SiO2, and the cavitation-resistant film 7 made of Ta that enhances cavitation-resistant property of the electrothermal conversion element are densely laminated on the temperature sensing element 3 via the interlayer insulating film 4 according to semiconductor processes.

Each temperature sensing element 3 (i.e., a thin-film resistor) is right below an associated heater 5. The wirings 31 and 33 connected to the temperature sensing elements are members constituting part of a detection circuit that detects information from the temperature sensing element.

The heater 5 and the Al wiring connecting the control circuit formed on the Si substrate are formed on the Si substrate 1 via the thermal accumulation layer 2 (e.g., thermal oxide film SiO2).

The heater (electrothermal transducer, electrothermal conversion element) 5 made of TaSiN, the passivation film 6 made of SiO2, and the cavitation-resistant film 7 made of Ta that enhances cavitation-resistant property of the electrothermal conversion element are formed via the interlayer insulating film 4 in the following manner.

Namely, the temperature sensing elements 3, the wirings 31 and 33 (connection wiring made of Al) are formed as film layers on a conventional thermal accumulation layer 2 on which the cavitation-resistant film 7 made of Ta is formed. The temperature sensing element 3 is made of a thin-film resistor (e.g., Al, Pt, Ti, TiN, TiSi, Ta, TaN, TaSiN, TaCr, Cr, CrSiN, or W).

Then, by patterning, the recording head 10 can be manufactured into a structure similar to that of a conventional recording head. Accordingly, the recording head 10 according to an exemplary embodiment brings excellent industrial productivity. The heater 5 of the recording head 10 is formed via the interlayer insulating film 4 and has a flat shape. Therefore, the recording head 10 has stable discharge characteristics.

Figure 2:
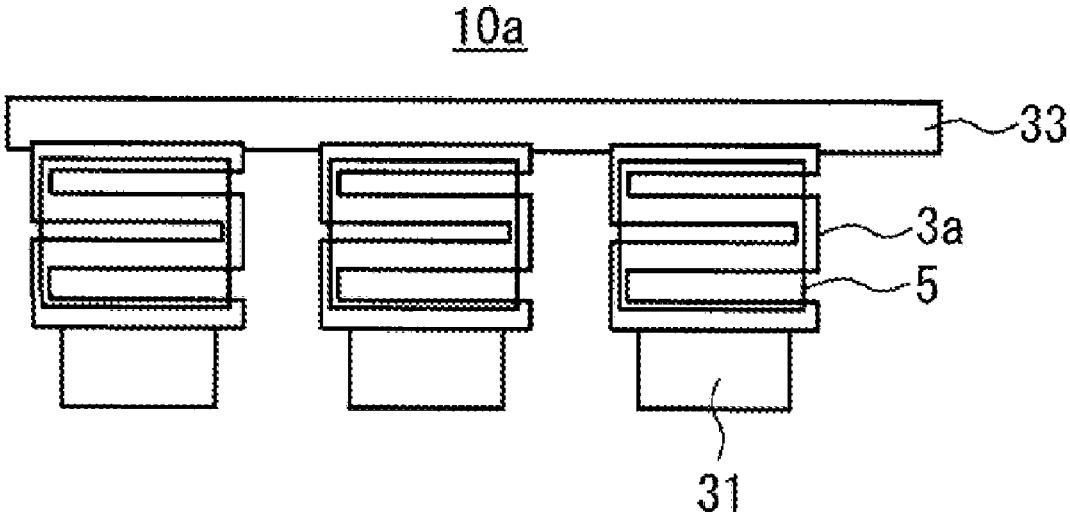
FIG. 2 illustrates a plan view of a modified recording head.

FIG. 2 illustrates a plan view of a recording head 10*a* which is a modified example of the recording head 10. The recording head 10*a* includes a snake-type temperature sensing element 3*a* disposed right below the heater 5. The snake-type temperature sensing element 3*a*, if its resistance value is set to a relatively large value, can accurately detect a small temperature change.

Figure 3:
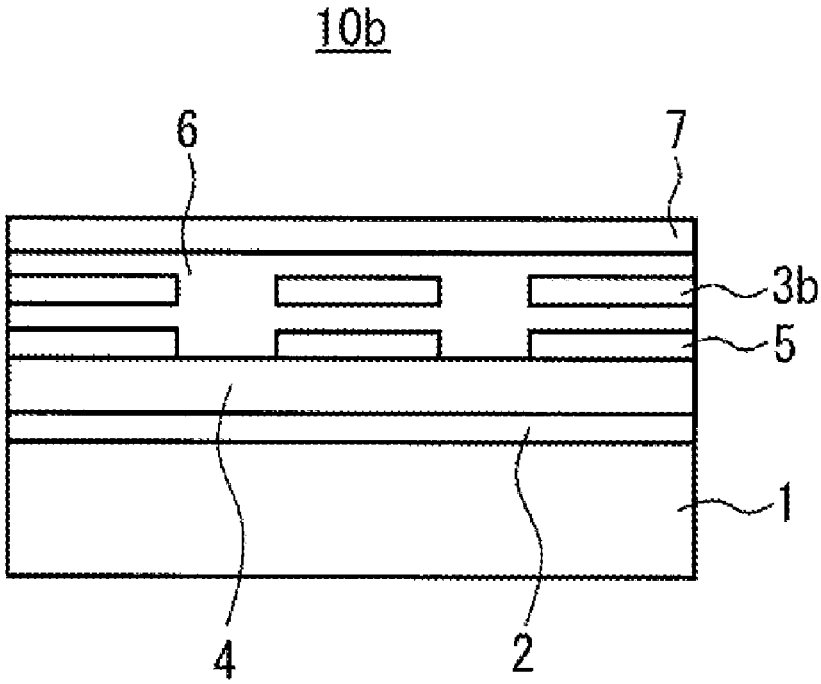
FIG. 3 illustrates a cross-sectional view of a modified recording head.

FIG. 3 illustrates a cross-sectional view of a recording head 10*b* which is another modified example of the recording head 10. According to the recording head 10 illustrated in FIG. 1, the temperature sensing element 3 is disposed right below the heater 5. According to the recording head 10*b* illustrated in FIG. 3, a temperature sensing element 3*b* is disposed right above the heater 5.

According to the recording head 10 illustrated in FIG. 1, the cavitation-resistant film 7 (i.e., a member that contacts ink) can be formed into a flat shape. According to the recording head 10*b* illustrated in FIG. 3, the temperature sensing element 3*b* is positioned more closely to an ink layer compared to the recording head 10 illustrated in FIG. 1. Therefore, a temperature change in the ink caused during an ink discharge operation can be accurately detected.

Figure 4:
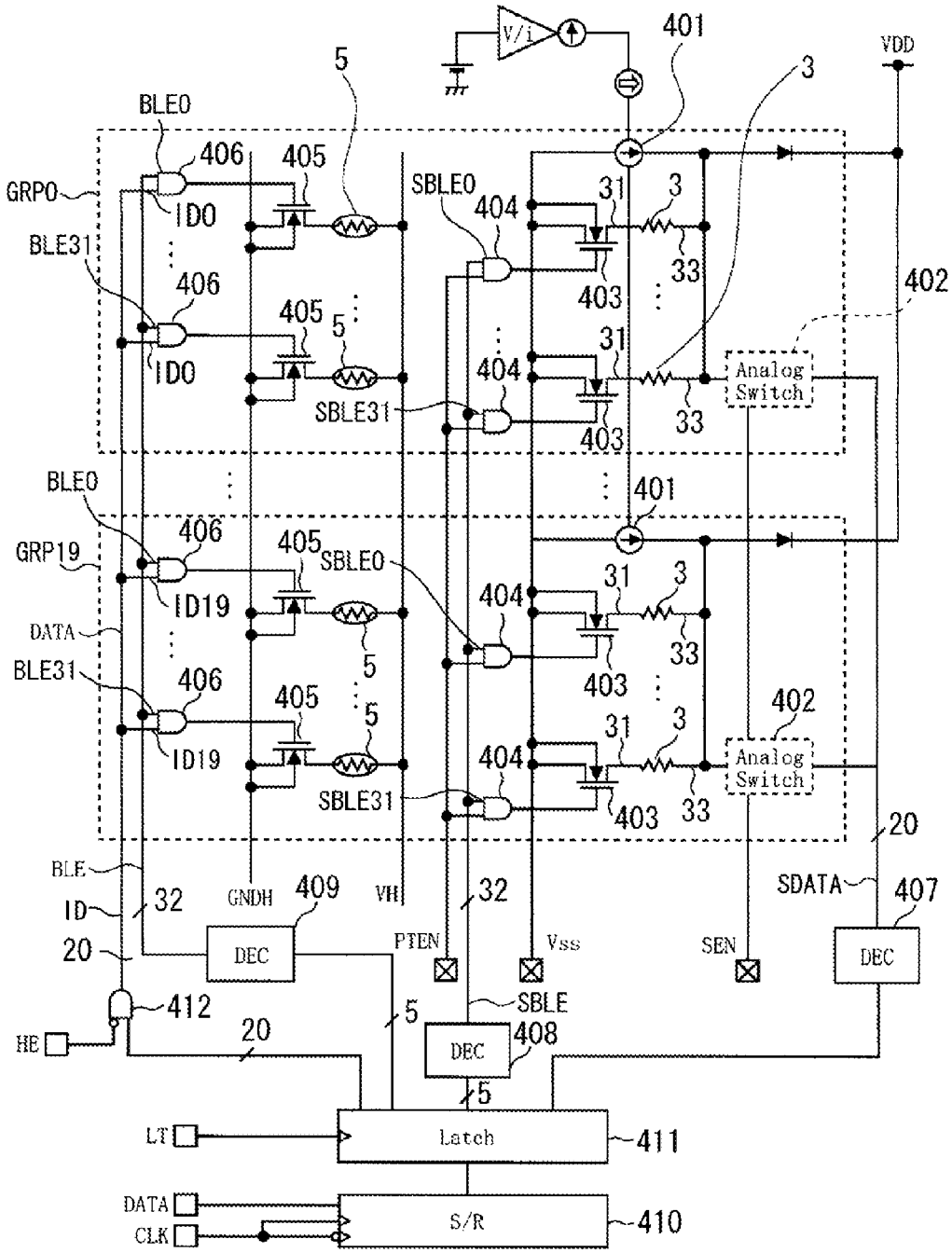
FIG. 4 illustrates a driving circuit according to a first exemplary embodiment.

FIG. 4 illustrates an example circuit including electrothermal transducers (electrothermal conversion elements) and temperature sensing elements (i.e., an example heater driving circuit and an example temperature sensing circuit) according to the first exemplary embodiment. One driving group (GRP) includes thirty-two heaters (electrothermal conversion elements) 5 which constitute a circuit unit. There are a total of twenty driving groups GRP0 through GRP19.

The circuit is configured to generate a signal ID (ID0~ID19) that selects a driving group and a BLE signal that select a heater 5 included in each driving group to drive a selected heater 5. According to the illustrated example, there are a total of twenty driving groups. Accordingly, for example, the circuit can generate a signal BLE0 to simultaneously drive twenty heaters 5. The circuit includes a switch 405 that turns the heater 5 on or off and an AND gate 406.

A signal DATA is serially transferred from a recording apparatus to a shift register (S/R) 410 in synchronism with a clock CLK. The data stored in the S/R 410 is stored (held) into the latch circuit 411 in synchronism with a signal LT. The circuit outputs the signal LT at the beginning of the next driving block. Accordingly, the driving timing based on initial transfer data is equal to the transfer timing of the next block.

The contents of the transferred data include an identification number of a block to be driven, driving data of the heater 5 (electrothermal conversion element) driven in the block, selection data for an analog switch circuit 402, and switching data for the temperature sensing element 3. A decoder 409 decodes the driving block into signal BLE0~31 to constantly drive only one of the thirty-two heaters 5. An AND gate 412 has one input terminal that receives a 20-bit ID signal (driving data signal) and another input that receives a pulse signal HE determining the drive timing of the heater 5.

The circuit designates a segment according to the driving data (i.e., 20-bit data) and drives the designated segment according to the timing of the pulse HE. Namely, the circuit drives the 0th block in response to a signal BLE0. The circuit successively drives 1st, 2nd, - - - blocks in response to signals BLE0~30, and finally drives the 31st block in response to the signal BLE31. In this manner, the circuit performs a driving operation for all heaters 5.

Next, an example operation of the temperature sensing circuit is described below. The temperature sensing element 3 has one end connected to a switch element 403 via the wiring 31. The temperature sensing element 3 has another end connected to a plurality of temperature sensing elements 3 via the Al wiring 33. Two or more temperature sensing elements 3 constitute a temperature sensing element group. A constant-current source 401 supplies constant current to one of the temperature sensing elements 3 constituting the temperature sensing element group. The analog switch circuit 402 switches an output of each temperature sensing element group. The switch element 403 turns on/off the temperature sensing element 3. The circuit includes an AND gate 404.

According to the above-described circuit arrangement, it is unnecessary to directly output temperature information from individual temperature sensing element group and therefore the total number of terminals can be reduced.

To select the temperature sensing element 3, a 1-bit SBLE signal (SBLE0~SBLE31) is connected to each sensing element group. Selection for this is similar to the selection of the recording element. The wirings corresponding to the number of elements constituting the temperature sensing element group are provided. A signal PTEN is commonly connected to the AND circuit 404 of each element.

The analog switch selects a temperature sensing element group that outputs an ON bit output converted into a voltage from its output terminal. According to the above-described circuit, at least one of the temperature sensing elements 3 can be wired to improve the circuit layout.

Figure 13:
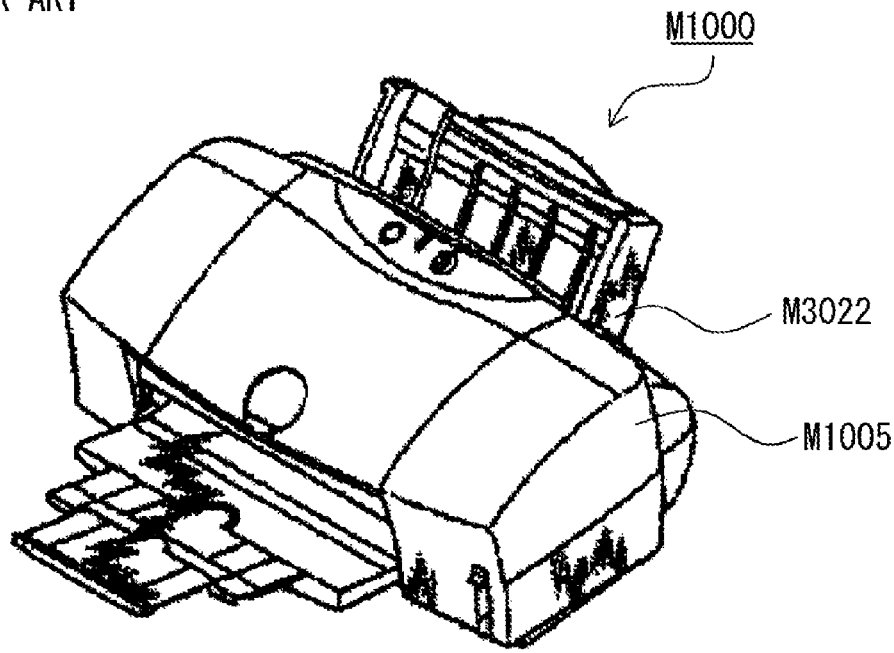
FIG. 13 PRIOR ART
FIG. 13 illustrates a perspective view of a conventional inkjet recording apparatus.
Figure 14:
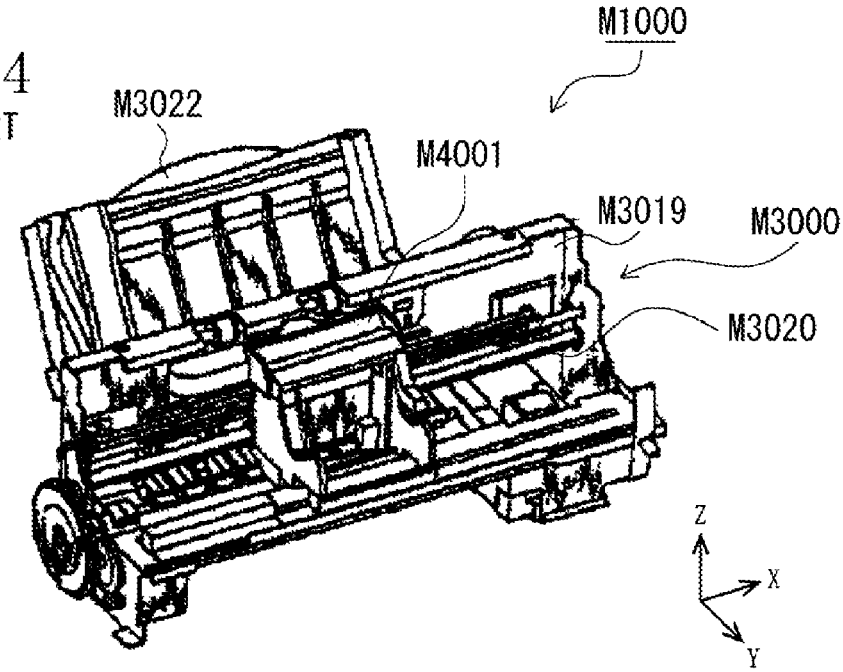
FIG. 14 PRIOR ART
FIG. 14 illustrates a perspective view of the interior of a conventional inkjet recording apparatus.
Figure 15:
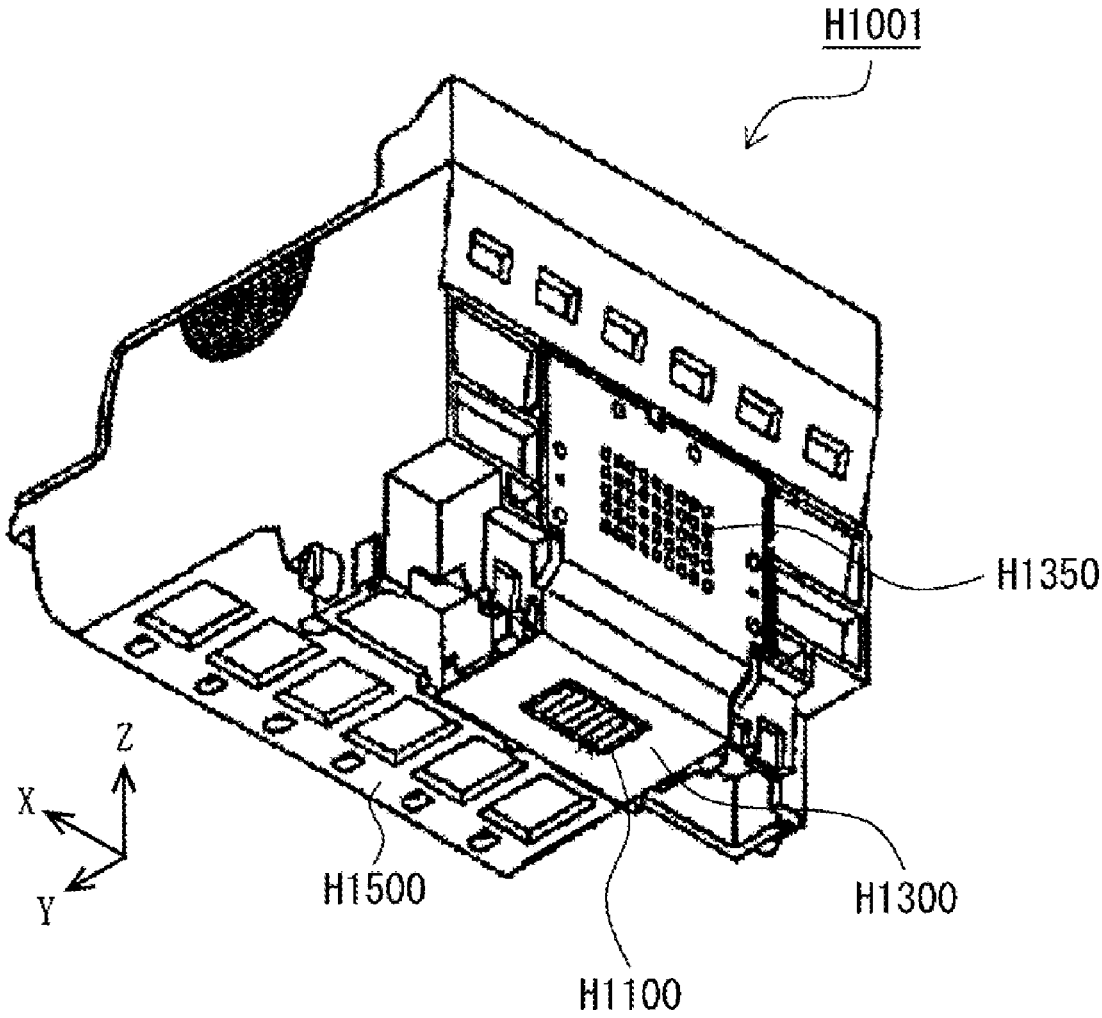
FIG. 15 PRIOR ART
FIG. 15 illustrates a perspective view of a recording head to be mounted on a carriage of the conventional inkjet recording apparatus, with discharge ports provided at a bottom side thereof.
Figure 16:
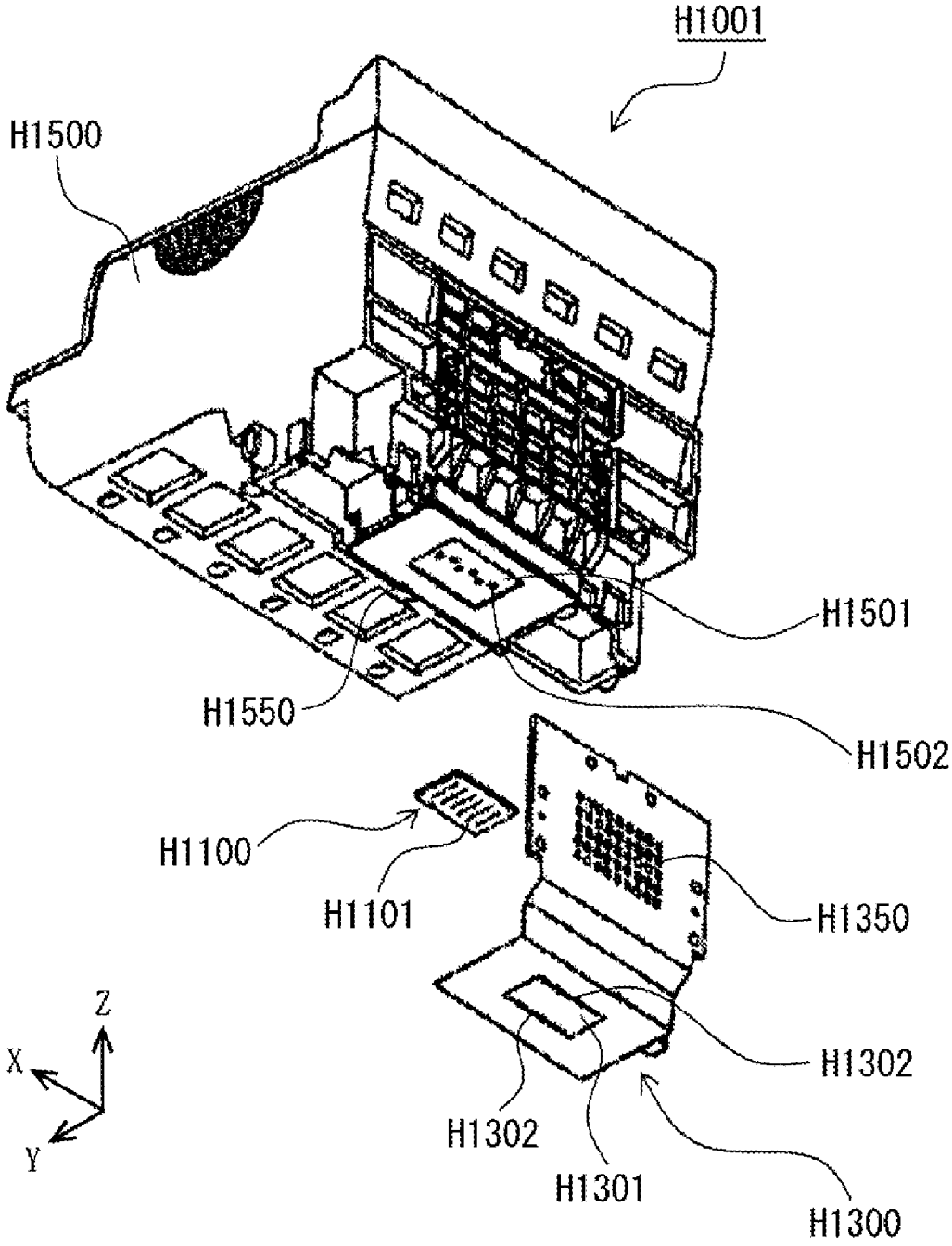
FIG. 16 PRIOR ART
FIG. 16 illustrates an exploded perspective view of the conventional recording head.
Figure 17A:
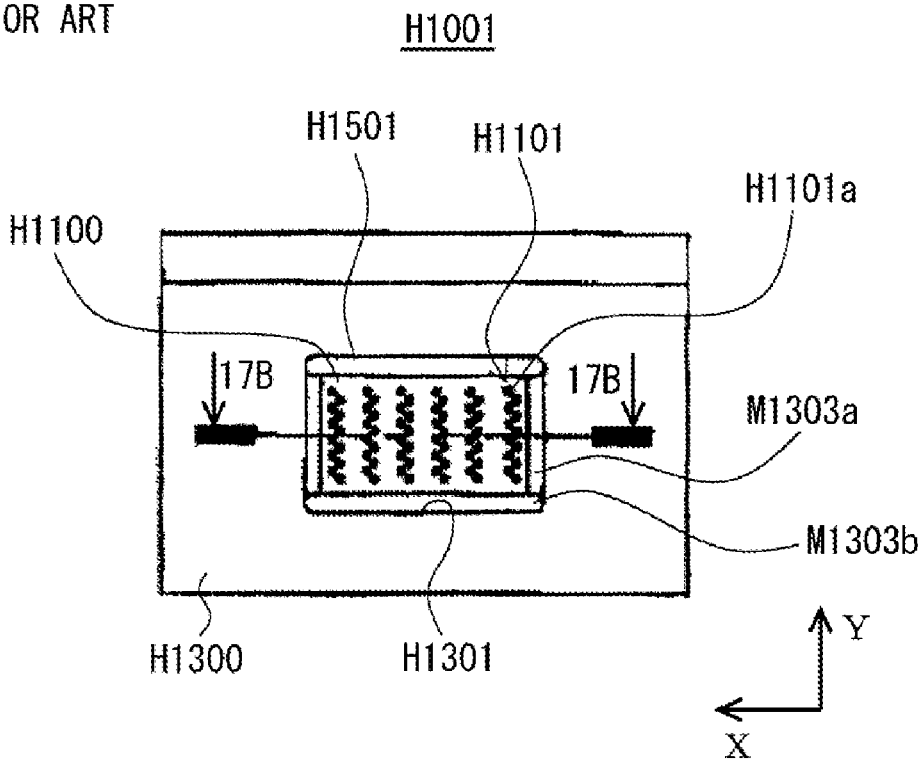
FIG. 17A PRIOR ART
FIGS. 17A and 17B illustrate discharge ports and a peripheral structure of a conventional recording head.
Figure 17B:
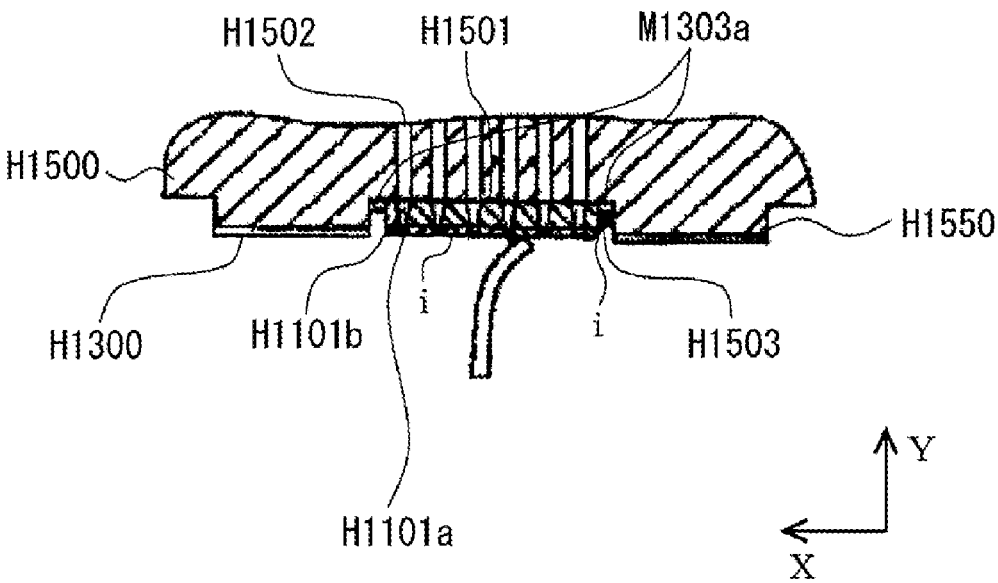
FIG. 17B PRIOR ART
Figure 18:
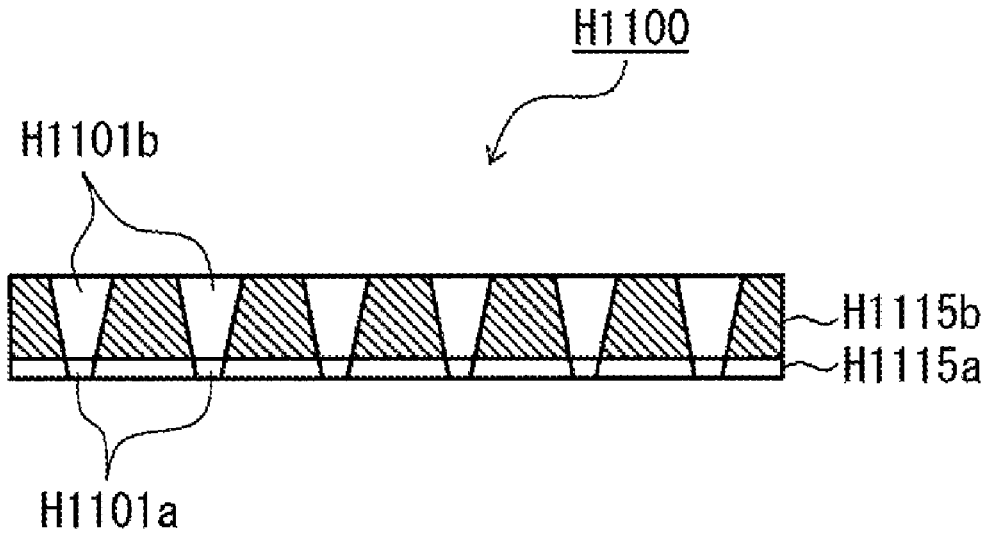
FIG. 18 PRIOR ART
FIG. 18 illustrates a cross-sectional view of a conventional recording element substrate.
Figure 19:
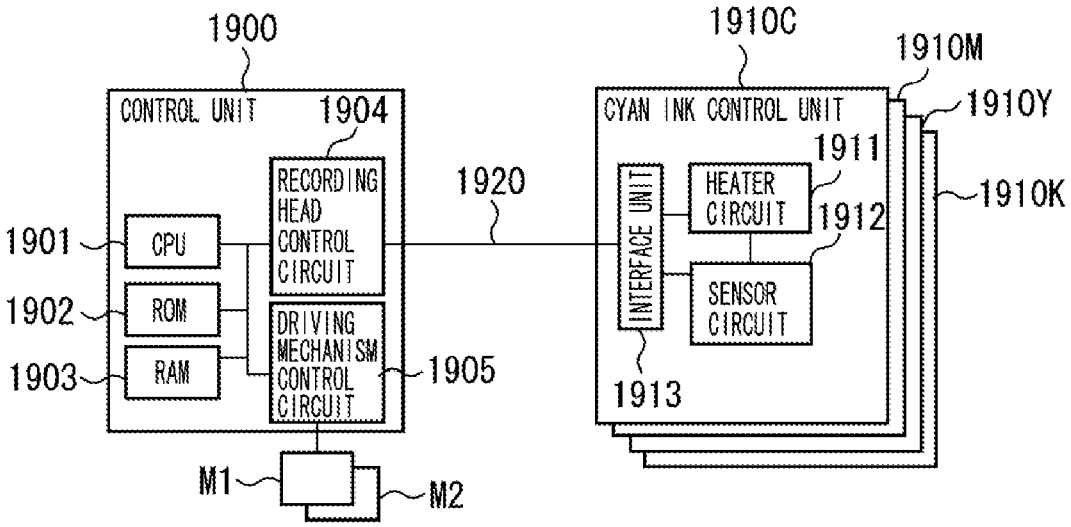
FIG. 19 illustrates a control block for a recording apparatus and a recording head.

FIG. 19 illustrates a control block for a recording apparatus and a recording head. A control unit 1900 controls a recording apparatus which is, for example, the inkjet recording apparatus illustrated in FIG. 13.

A control processing unit (CPU) 1901 controls the recording apparatus that performs various operations. For example, the CPU 1901 controls the recording head that performs a scanning operation and controls a driving mechanism that conveys a recording medium. A read only memory (ROM) 1902 stores control program(s) and control data for the CPU 1901. A random access memory (RAM) 1903 includes a work memory area for the CPU 1901.

More specifically, the CPU 1901 controls a recording head control circuit 1904 and a driving mechanism control circuit 1905. The recording head control circuit 1904 is connected to a plurality of ink control units (e.g., a cyan ink control unit 1910C, a magenta ink control unit 1910M, a yellow ink control unit 1910Y, and a black ink control unit 1910K). The driving mechanism control circuit 1905 is connected to various driving mechanisms (including motors) such as a driving mechanism M1 for scanning the recording head and a driving mechanism M2 for conveying a recording medium.

The ink control units 1910C, 1910M, 1910Y, and 1910K are identical in configuration. Therefore, the cyan ink control unit 1910C is described below in detail.

A heater circuit 1911 includes the heater 5 and the switch 405 illustrated in FIG. 4. A sensor circuit 1912 includes the temperature sensing element 3, the analog switch circuit 402, and the switch element 403 illustrated in FIG. 4. An interface unit 1913 includes the S/R 410, the latch circuit 411, and the decoders 407~409 illustrated in FIG. 4. An interface 1920 can transmit various signals (e.g., HE, LT, CLK, DATA, and SEN) and voltages (e.g., VH and Vss).

Figure 5:
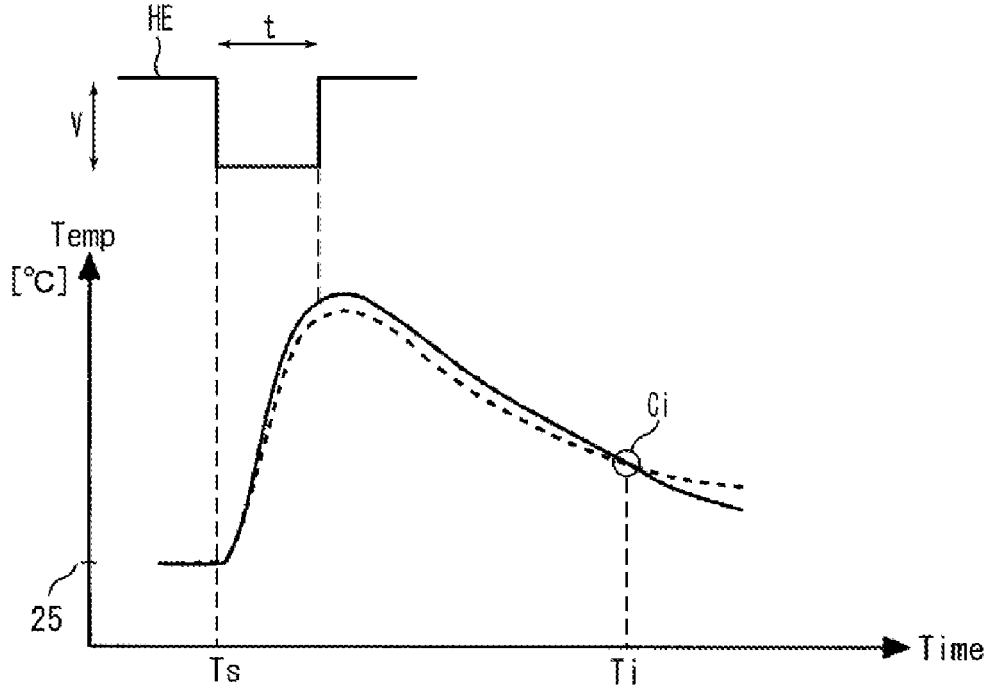
FIG. 5 is a graph illustrating a pulse signal applied to a heater, a temperature curve measured by a temperature sensing element, and processing performed according to the first exemplary embodiment.

FIG. 5 illustrates a voltage waveform HE applied to the heater 5 and a temperature curve measured by the temperature sensing element 3. In this case, the interlayer insulating film 4 has a film thickness of 0.95 μm and the heater 5 has a resistance value of 360Ω.

For example, if a pulse signal of voltage V=20[V] and pulse width t=t1 (0.80 [μs]) is applied to the heater 5 in the initial temperature condition of 25° C., the recording head can normally discharge an ink droplet from a discharge port. In this case, the temperature sensing element 3 can detect a result indicated by a solid line in FIG. 5.

On the other hand, if a pulse signal of voltage V=20[V] and pulse width t=t2 (0.79 [μs]) is applied to the heater 5, the recording head cannot discharge any ink droplet from a discharge port although a meniscus appears before the ink starts retracting inward. In this case, the temperature sensing element 3 can detect a result indicated by a dotted line in FIG. 5. The results illustrated in FIG. 5 can be experimentally obtained.

If the pulse width is longer than 0.8 μs when the pulse signal has a voltage V=20[V], a change point Ci of temperature fall gradient (i.e., temperature change ratio per unit time) appears in a temperature fall interval of temperature information detected by the temperature sensing element 3. The change point Ci represents an abrupt change in the speed of temperature fall.

According to the illustrated example, the change point Ci appears at timing Ti when 10 μs has elapsed after timing Ts (i.e., application of the pulse signal). The timing Ti corresponding to the change point Ci is variable depending on the characteristics of each recording head. However, the change point Ci appears in the temperature fall interval within 12 μs after application of the pulse signal. On the other hand, if the pulse width is less than 0.8 μs, the change point Ci does not appear.

More specifically, the tail of a discharged ink droplet contacts the heater and receives heat from the heater. Therefore, the temperature greatly changes and causes a change point in the temperature fall.

Figure 6:
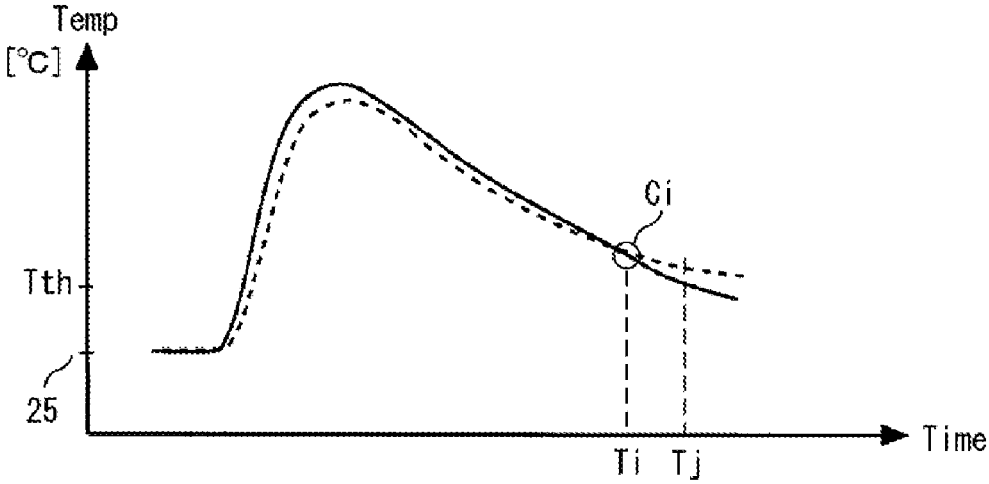
FIG. 6 is a graph illustrating a temperature curve measured by a temperature sensing element and processing performed according to a second exemplary embodiment of the present invention.

Next, FIG. 6 illustrates an example temperature curve measured when a voltage value is changed under a condition where the pulse width of the pulse signal applied to the heater 5 is fixed. Conditions for the example illustrated in FIG. 6 are similar to the conditions for the example illustrated in FIG. 5. Namely, the interlayer insulating film 4 has the same film thickness (=0.95 μm) and the heater 5 has the same resistance value (=360Ω). FIG. 6 omits the waveform of a pulse signal.

In FIG. 6, a solid line indicates a temperature curve obtained when the applied pulse signal has a voltage V=20[V] and a pulse width t=t1 (0.80 [μs]) in the initial temperature condition of 25° C. In this case, the recording head can normally discharge an ink droplet from a discharge port. However, if the applied pulse signal has a voltage V=19.8 [V] and a pulse width t=t1 (0.80 [μs] the recording head cannot discharge any ink droplet from a discharge port. A dotted line of FIG. 6 indicates a temperature change measured in this case.

Similar to the example illustrated in FIG. 5, in the example illustrated in FIG. 6, if the applied pulse signal has a voltage V=20 [V], the change point Ci appears in the temperature fall interval. However, if the applied voltage is less than 20 [V], the change point Ci does not appear in the temperature fall interval.

The thermal energy (i.e., Joule heat) generated in the heater 5 in response to an applied voltage can be expressed by the following formula.

$$Q=(V/(Rh+Rw+Ron))^2\times Rh\times t$$

where Rh represents a resistance value of the heater 5, Rw represents a resistance value of the wiring, Ron represents an ON-resistance value of the switch (MOS transistor), V represents a voltage value applied to the heater 5, and "t" represents the time during which the voltage is applied.

Accordingly, a minimum Joule heat amount required for a normal ink discharge operation can be obtained from a temperature curve measured by the temperature sensor (the temperature sensing element 3). As the circuit (See FIG. 4) may made up of a plurality of heaters 5, each heater 5 having a plurality of temperature sensing elements 3, a plurality of temperature curves (i.e. temperature change curves) may be generated. An applied voltage or a pulse width can be calculated from the above-described formula.

As described above, the driving conditions (including the applied voltage or the pulse width) can be determined based on the (minimum) energy (Joule heat) required for an ink discharge operation. The driving operation can be performed based on the driving conditions. By performing the above-described processing, the driving operation for the heater 5 can be performed based on appropriate driving conditions even if characteristic changes or aging changes occur in each recording head or in each heater. Thus, the ink discharge operation can be stabilized. The life span of the heater 5 can be increased.

Next, in a case where an inkjet recording apparatus having the above-described configuration is used as a common apparatus, an example method for determining a minimum input energy value required for discharging an ink droplet is described below.

Figure 7:
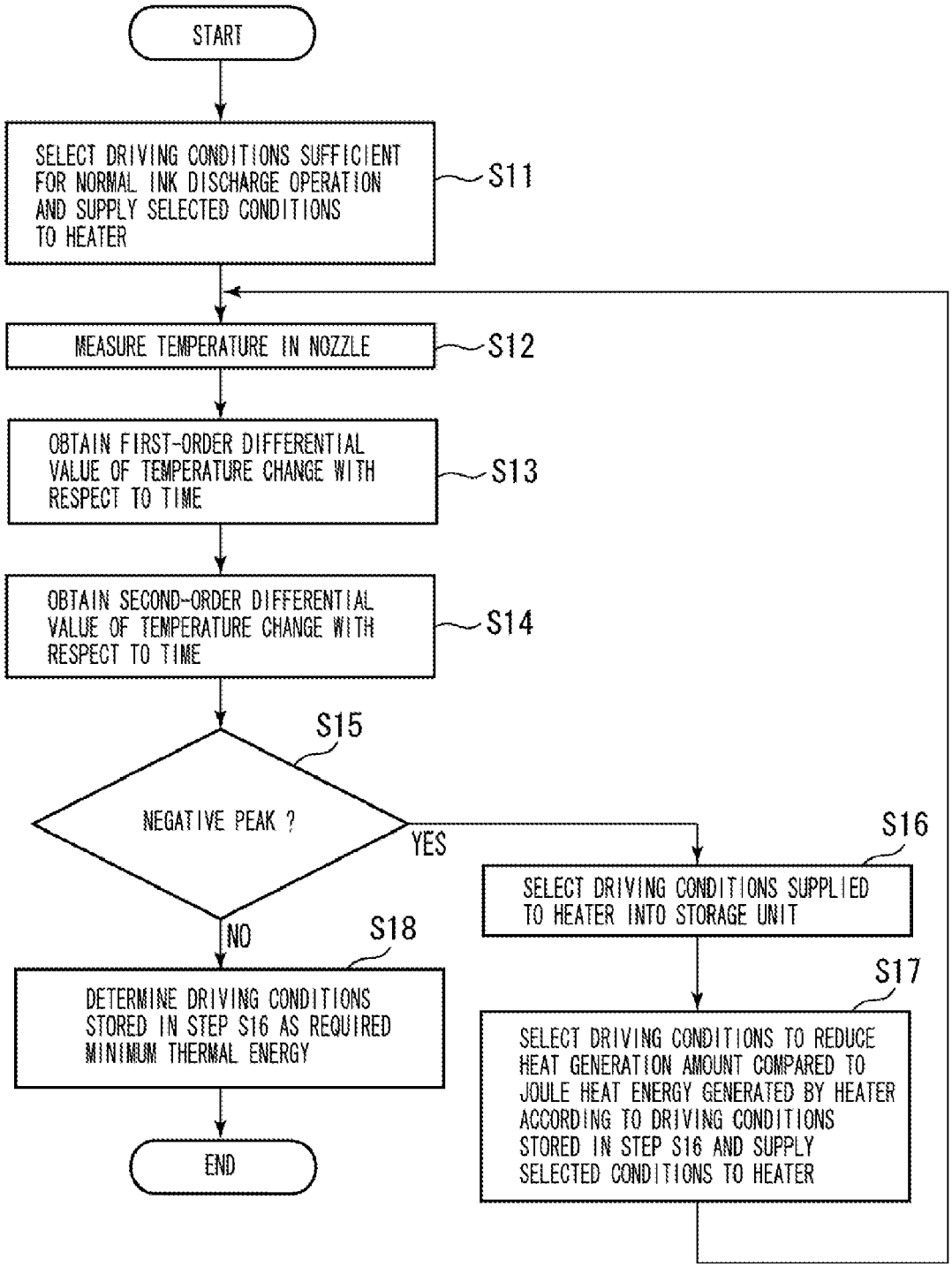
FIG. 7 is a flowchart illustrating an example operation for determining a minimum energy value required for discharging an ink droplet.

FIG. 7 is a flowchart illustrating an example operation for determining a (minimum) energy value required for discharging an ink droplet. The CPU 1901 of the above-described recording apparatus can execute this control.

Figure 8A:
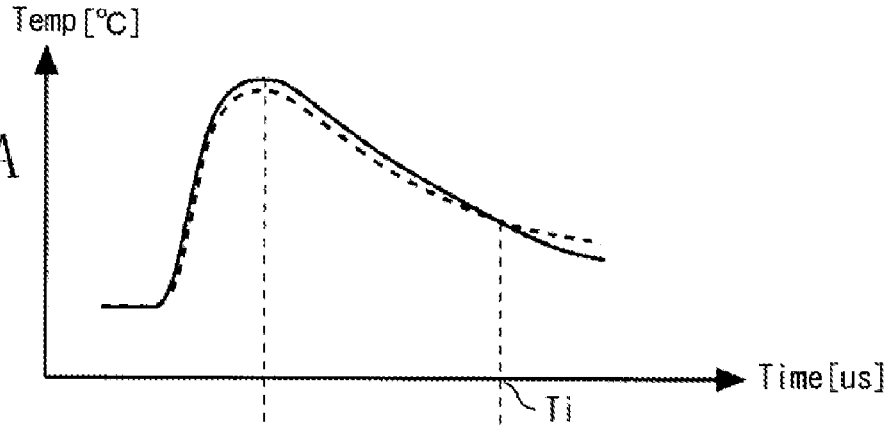
FIGS. 8A through 8C are graphs illustrating an example method for calculating a minimum input energy threshold required for discharging an ink droplet according to the first exemplary embodiment.
Figure 8B:
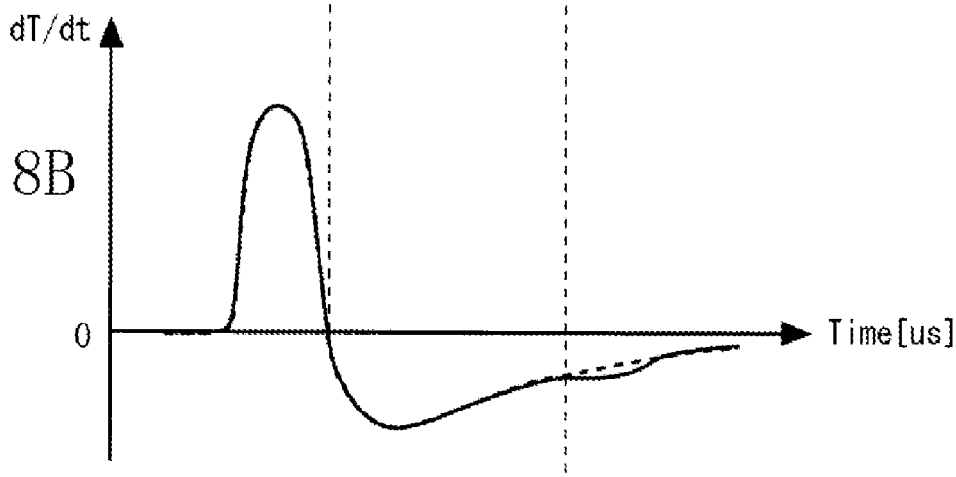
Figure 8C:
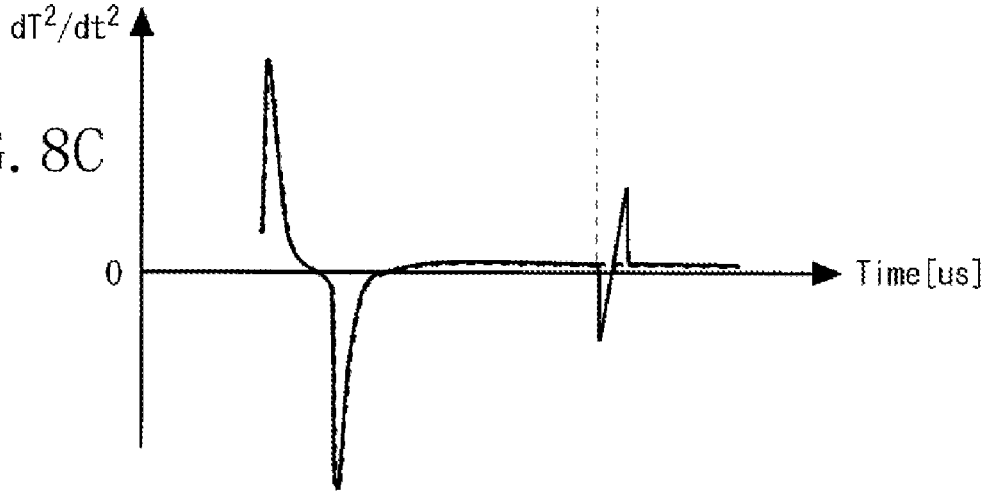

FIGS. 8A through 8C are graphs illustrating an example method for calculating a minimum input energy threshold required for discharging an ink droplet according to the first exemplary embodiment. In this example, the recording head has characteristics similar to those described with reference to FIG. 5.

In step S11, the CPU 1901 selects driving conditions sufficient for a normal ink discharge operation and applies a pulse signal to the heater 5. For example, the CPU 1901 sets voltage V=20[V] and pulse width t=0.88 [μs] as initial values.

In step S12, the CPU 1901 causes a temperature sensor to measure the temperature in a nozzle. The CPU 1901 stores measured temperature data into a memory.

In step S13, the CPU 1901 inputs a temperature change curve, or a plurality of temperature change curves if a plurality of temperature sensing elements 3 are used, into a differentiator. The temperature change curve(s) can be obtained from the temperature data measured in step S12. Then, the CPU 1901 obtains a first-order differential curve, or a plurality of first-order differential curves if a plurality of temperature sensing elements 3 are used, of the temperature change curve(s) with respect to time. FIG. 8B illustrates a calculation result of the first-order differential curve(s) of the temperature change(s).

In step S14, the CPU 1901 differentiates the first-order differential value(s) of the temperature change curve(s) obtained in step S13. Namely, the CPU 1901 obtains a second-order differential curve, or a plurality of second-order differential curves if a plurality of temperature sensing elements 3 are used, of the temperature change curve(s) with respect to time, or a differential curve(s). FIG. 8C illustrates a calculation result of the second-order differential curve(s), or differential curve(s), of the temperature change.

In step S15, the CPU 1901 performs a determination for the second-order differential curve(s), or differential curve(s), of the temperature change curve(s) obtained in step S14. Namely, the CPU 1901 determines whether a negative peak appears after the second-order differential value(s) becomes 0 twice. Namely, the CPU 1901 determines whether any peak is present. If the CPU 1901 determines that a peak is present (YES in step S15), the control flow proceeds to step S16. In step S16, the CPU 1901 stores the driving conditions supplied to the heater 5 into a storage unit.

Then, in step S17, the CPU 1901 changes driving conditions so that the heat generation amount can be decreased compared to the Joule heat energy generated by the heater 5 in the previous driving operation. For example, the CPU 1901 decreases the pulse width by 0.02 [.mu.s]. Accordingly, the CPU 1901 sets voltage V=20[V] and pulse width t=0.86 [.mu.s] for the next driving operation. The CPU 1901 applies a pulse signal corresponding to the changed driving conditions to the heater 5. Subsequently, the control flow returns to step S12. The CPU 1901 repetitively performs the processing of steps S12 through S15 until the CPU 1901 determines that there is not any peak (NO in step S15). In other words, as the processing of steps S12 through S17 is performed, the differential curve(s) is compared against the criteria of the presence or absence of a peak, as specified in step S15, until the acceptance criteria of the absence of a peak is satisfied.

If the CPU 1901 determines that there is not any peak (NO in step S15), the control flow proceeds to step S18. The driving conditions in this determination processing are the voltage V=20[V] and the pulse width t=0.78 [μs]. Therefore, in step S18, the CPU 1901 determines the values (voltage V=20[V], pulse width t=0.80 [μs]) stored in the latest processing of step S16 as (minimum) driving conditions required for discharging an ink droplet.

In step S17, instead of reducing the pulse width while fixing the driving voltage, it is possible to reduce the driving voltage while fixing the pulse width.

In the first exemplary embodiment, the initial conditions are conditions sufficient for a normal ink discharge operation. Alternatively, driving conditions (e.g., voltage V=20[V], pulse width t=0.70 [μs]) insufficient for a normal ink discharge operation can be set as initial conditions.

In this case, for example, when the CPU 1901 performs the determination processing in step S15, the CPU 1901 changes the driving conditions so that the Joule heat energy generated by the heater 5 can be gradually increased. For example, the CPU 1901 increases the pulse width by 0.02 [μs]. Then, in step S18, the CPU 1901 determines driving conditions corresponding to the determination of "presence of a peak" as (minimum) driving conditions required for discharging an ink droplet.

Second Exemplary Embodiment

The first exemplary embodiment determines the driving conditions for the heater 5 based on the presence of an inflection point (change point) Ci appearing in a temperature fall interval. An example method according to a second exemplary embodiment can determine driving conditions without relying on the presence of the inflection point Ci. More specifically, the method according to the second exemplary embodiment includes a determination of driving conditions for the heater 5 based on a temperature value measured after the timing Ti.

Figure 9:
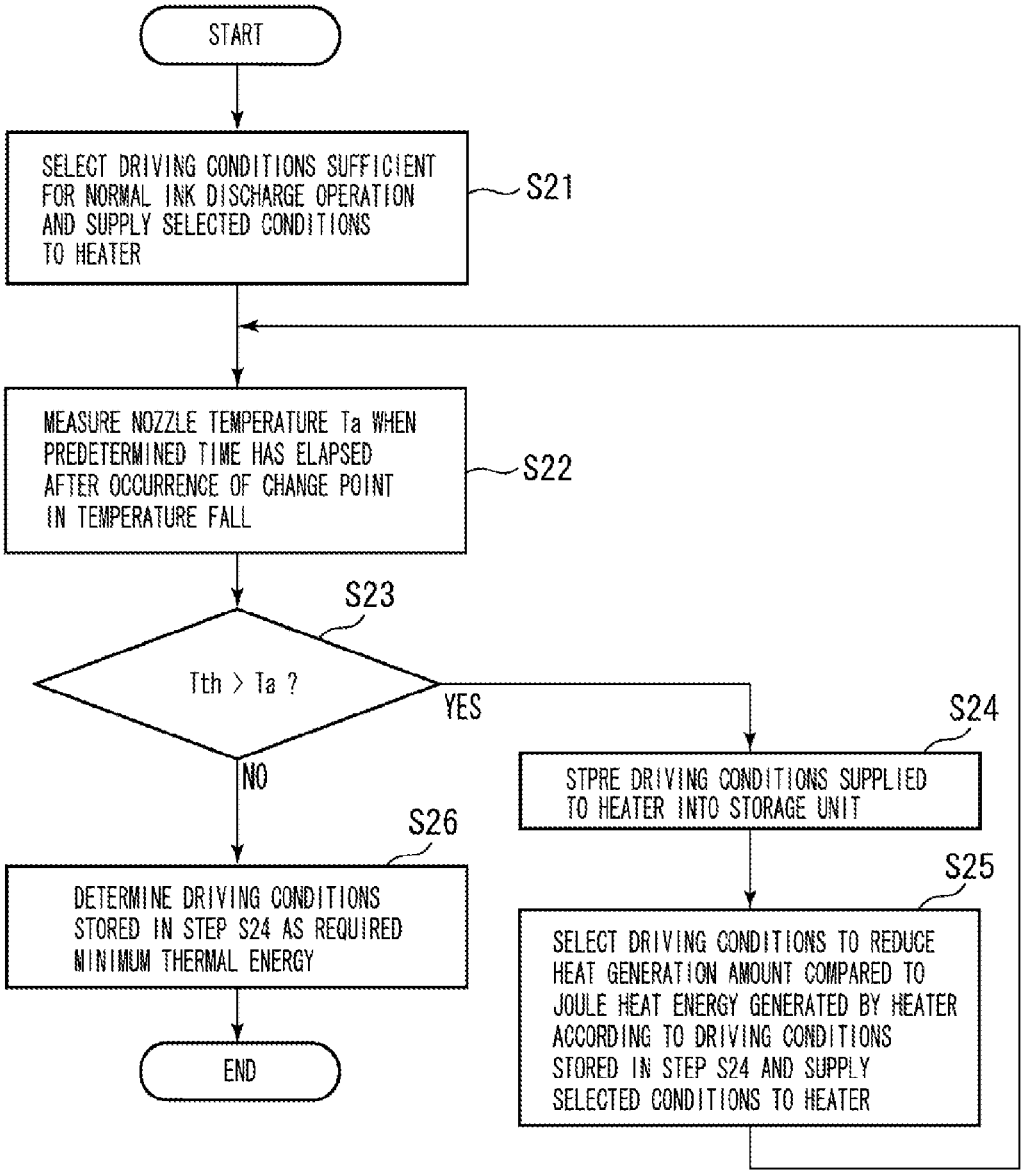
FIG. 9 is a flowchart illustrating an example operation for determining a minimum energy value required for discharging an ink droplet according to a second exemplary embodiment.

FIG. 9 is a flowchart illustrating an example operation for determining a minimum energy value required for discharging an ink droplet according to the second exemplary embodiment. The control procedure illustrated in FIG. 9 includes steps S22 and S23 having processing contents not illustrated in FIG. 7. Accordingly, the processing of steps S22 and S23 is described below in detail.

In step S21, the CPU 1901 selects driving conditions sufficient for a normal ink discharge operation and applies a pulse signal to the heater 5. Step S21 is similar to step S11 illustrated in FIG. 7.

In step S22, the CPU 1901 causes the temperature sensor (the temperature sensing element 3) to measure a nozzle temperature Ta at timing Tj (i.e., when a predetermined time has elapsed after timing Ti). For example, there is a time difference of 2 μs between the timing Tj and the timing Ti. The temperature sensor (the temperature sensing element 3) measures a nozzle temperature Ta at the timing Tj. The timing values Ti and Tj can be experimentally obtained beforehand.

In step S23, the CPU 1901 compares a predetermined threshold Tth with the temperature Ta measured in step S22. If the CPU 1901 determines that a relationship "Tth>Ta" is satisfied (YES in step S23), the control flow proceeds to step S24.

In step S24, the CPU 1901 stores the driving conditions supplied to the heater 5 into a storage unit.

In step S25, the CPU 1901 changes the driving conditions in the same manner as the processing in step S17 of FIG. 7.

Subsequently, the control flow returns to step S22. The CPU 1901 repetitively performs the processing of steps S22 through S25 to update the driving conditions stored in the storage unit until the CPU 1901 determines that a relationship "Ta≧Tth" is satisfied in step S23.

If the CPU 1901 determines that the relationship "Ta≧Tth" is satisfied (NO in step S23), the control flow proceeds to step S26.

In step S26, the CPU 1901 determines that the conditions stored in step S24 as required minimum driving conditions for discharging an ink droplet. In an example method for changing the driving conditions, the CPU 1901 can decrease the driving voltage while fixing the pulse width.

In the second exemplary embodiment, the initial driving conditions are conditions sufficient for a normal ink discharge operation. However, it is possible to initially set a small energy level (driving condition) insufficient for a normal ink discharge operation and gradually increase the energy level for determination.

Third Exemplary Embodiment

An example method according to a third exemplary embodiment can determine driving conditions without relying on the presence of the inflection point Ci. More specifically, the method according to the third exemplary embodiment includes a determination of driving conditions for the heater 5 based on an integrated temperature value measured after the timing Ti corresponding to the inflection point Ci.

Figure 10:
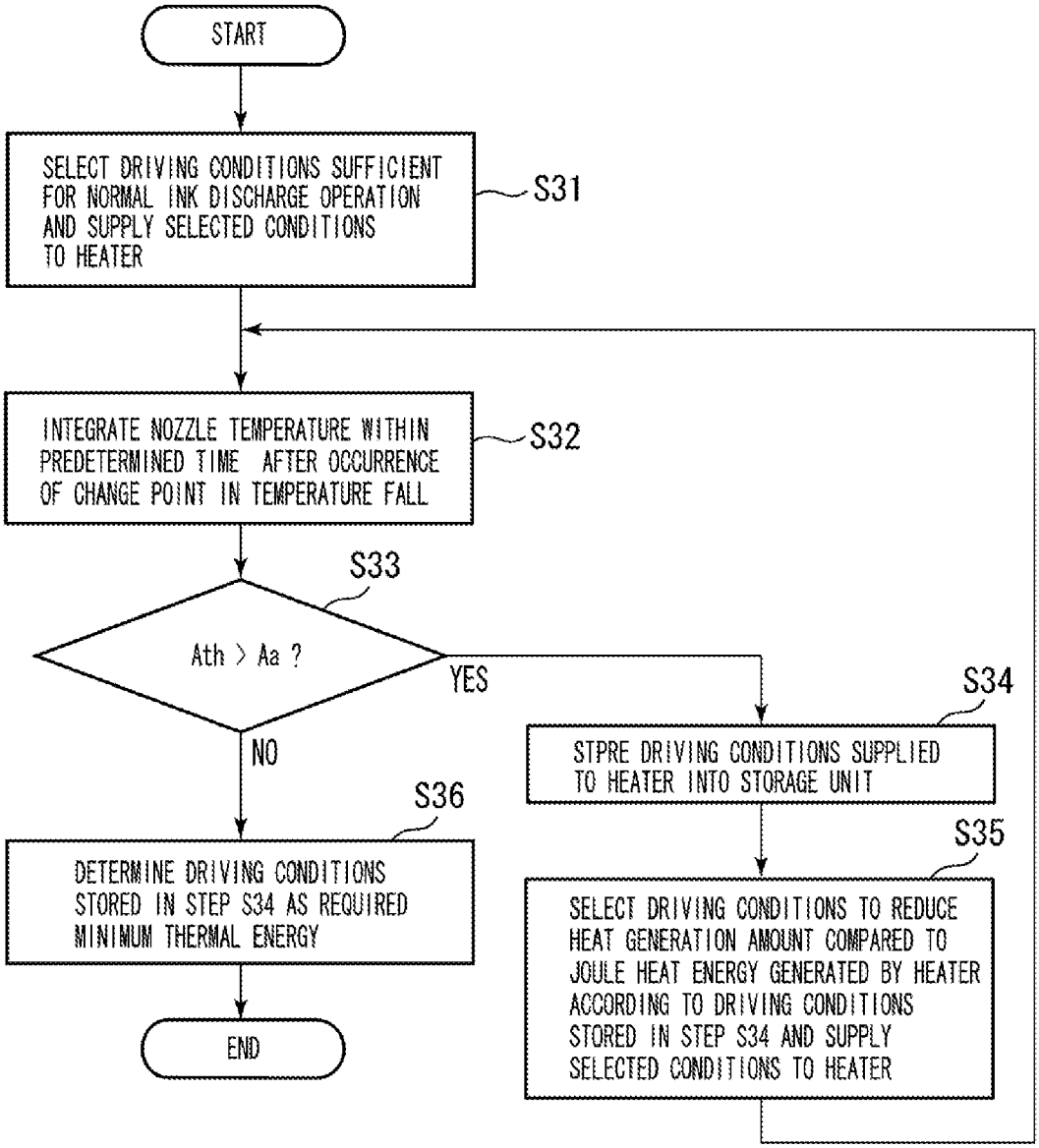
FIG. 10 is a flowchart illustrating an example operation for determining a minimum energy value required for discharging an ink droplet according to a third exemplary embodiment.

FIG. 10 is a flowchart illustrating an example operation for determining a minimum energy value required for discharging an ink droplet according to the third exemplary embodiment. The control procedure illustrated in FIG. 10 includes steps S32 and S33 having processing contents not illustrated in FIG. 7. Accordingly, the processing of steps S32 and S33 is described below in detail. In this example, timings Ti and Tk are known values experimentally obtained.

In step S31, the CPU 1901 selects driving conditions sufficient for a normal ink discharge operation and applies a pulse signal to the heater 5.

In Step S32, the CPU 1901 causes the temperature sensor to measure the temperature in a nozzle and stores measured temperature data into a memory. Then, the CPU 1901 integrates temperature data stored in the memory within a predetermined period of time after the timing Ti.

The CPU 1901 can perform the temperature data integration processing by integrating temperature data in a period of time between timing Ti and timing Tk if filling up ink from a common fluid chamber to the discharge port completely terminates at timing Tk.

Figure 20:
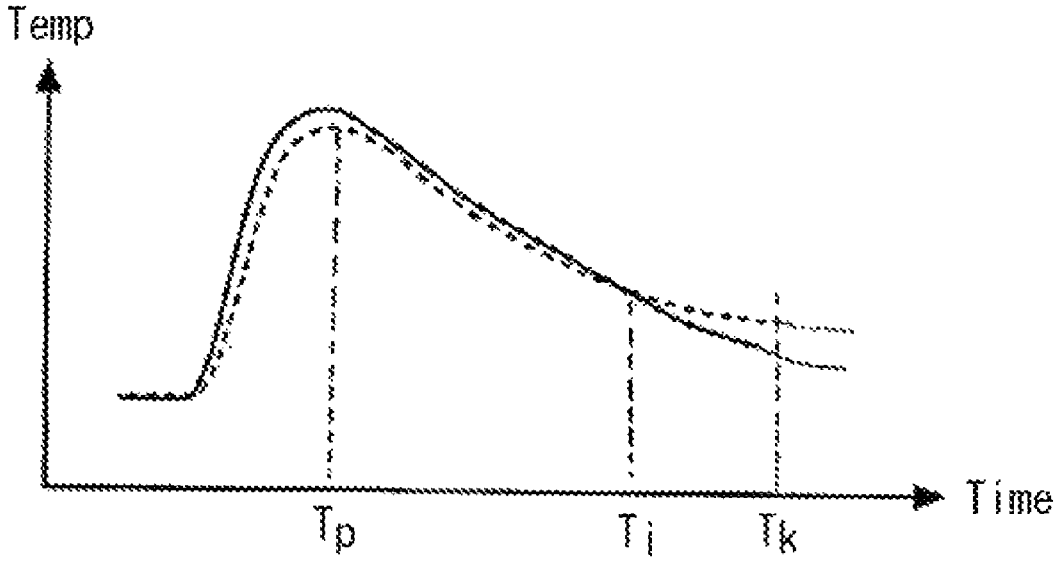
FIG. 20 is a graph illustrating a temperature curve measured by a temperature sensing element and processing performed according to a third exemplary embodiment.

Example processing for integrating temperature data is described below with reference to FIG. 20. For example, the CPU 1901 obtains an integrated value Aa by integrating temperature data in a period of time from timing Tp to timing Tk. The timing Tp is 6.0 μs later than the application of the pulse signal to the heater 5. The timing Tk is 15 μs later than the application of the pulse signal to the heater 5.

Next, in step S33, the CPU 1901 compares a predetermined threshold Ath with the integrated value Aa measured in step S32. If the CPU 1901 determines that a relationship "Ath>Aa" is satisfied (YES in step S33), the control flow proceeds to step S34. In step S34, the CPU 1901 stores the driving conditions supplied to the heater 5 into a storage unit.

In step S35, the CPU 1901 changes the driving conditions in the same manner as the processing of step S17 in FIG. 7. Subsequently, the control flow returns to step S32. The CPU 1901 repetitively performs the processing of steps S32 through S35 to update the driving conditions stored in the storage unit until the CPU 1901 determines that a relationship "Aa≧Ath" is satisfied in step S33.

If the CPU 1901 determines that the relationship "Aa≧Ath" is satisfied (NO in step S33), the control flow proceeds to step S36. In step S36, the CPU 1901 determines that the conditions stored in step S34 as required minimum driving conditions for discharging an ink droplet.

In the third exemplary embodiment, the initial driving conditions are conditions sufficient for a normal ink discharge operation. However, it is possible to initially set a small energy level (driving condition) insufficient for a normal ink discharge operation and gradually increase the energy level for determination.

Other Exemplary Embodiment

According to the above-described first through third exemplary embodiments, temperature information of the heater 5 is obtained by a temperature sensor disposed right below or right above the heater 5. For example, the CPU 1901 can select one temperature sensor from a plurality of temperature sensors included in a driving block constituting the heater 5. Then, the CPU 1901 can determine minimum driving conditions required for an ink droplet discharge operation based on temperature information measured by the selected temperature sensor.

Furthermore, the configuration of the recording head is not limited to the above-described examples. FIGS. 11 and 12 illustrate example configurations of another recording head.

Figure 11A:
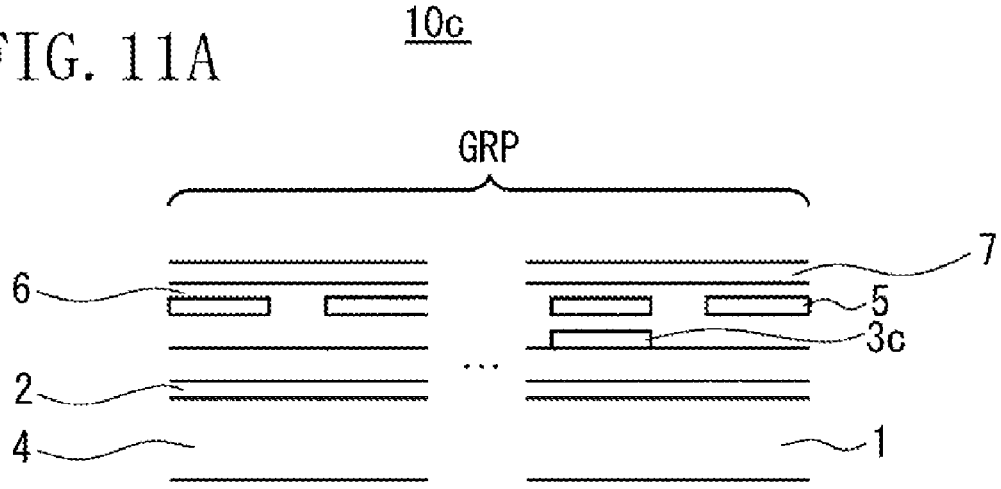
FIGS. 11A and 11B illustrate an example recording head according to other exemplary embodiments of the present invention.
Figure 11B:
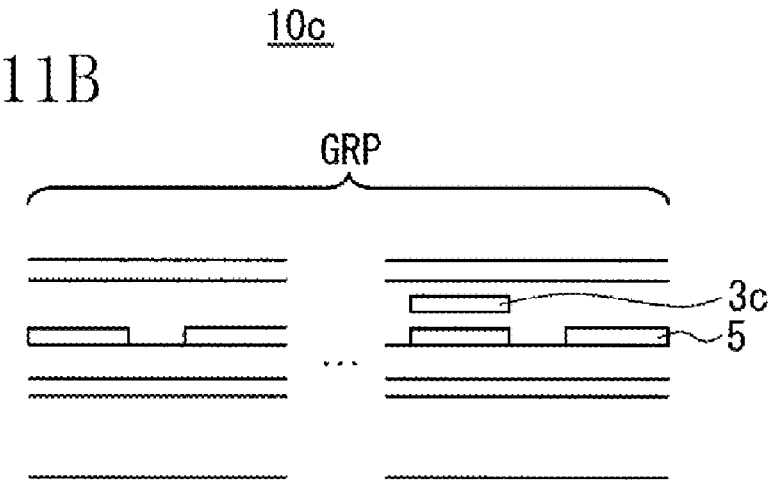

A recording head 10c illustrated in FIGS. 11A and 11B includes only one temperature sensor in each circuit (GRP). For example, one temperature sensor is provided in the circuit GRP0 of FIG. 4. Each circuit (GRP0) includes thirty-one heaters 5. The temperature sensing element 3*c* is disposed right below or right above one heater. The CPU 1901 determines minimum driving conditions for discharging an ink droplet based on temperature information measured by the temperature sensing element 3*c*.

According to the recording head 10c illustrated in FIGS. 11A and 11B, the response to a temperature change becomes dull. However, the heater 5 can be configured into a flat shape in a region where the temperature sensing element 3*c* is not provide. Thus, the ink discharge operation can be stabilized.

Figure 12A:
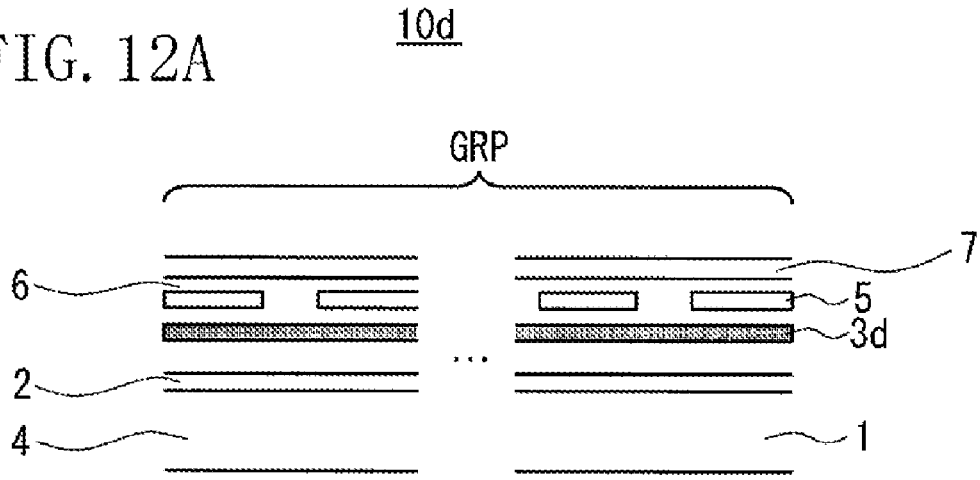
FIGS. 12A and 12B illustrate an example recording head according to another exemplary embodiment of the present invention.
Figure 12B:
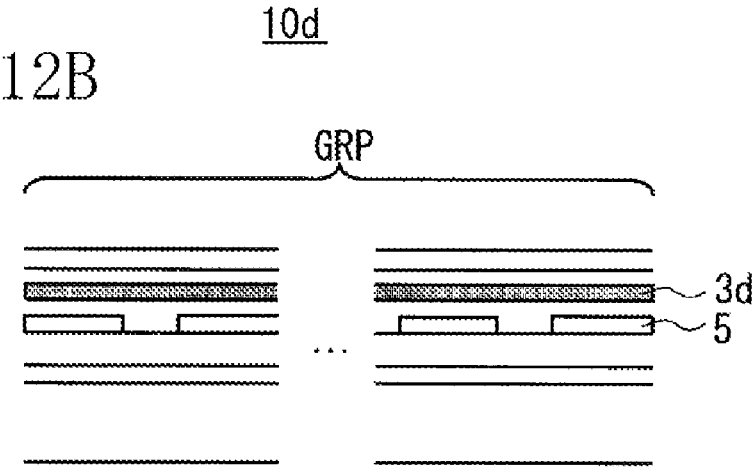

A recording head 10*d* illustrated in FIGS. 12A and 12B includes only one temperature sensing element 3*d* in each circuit (GRP). Each circuit (GRP) includes a plurality of heaters 5. The temperature sensing element 3*d* has a large size comparable to a plurality of heaters disposed right above or right below the element 3*d* as illustrated in FIGS. 12A and 12B. Namely, the temperature sensing element 3*d* has a wide area larger than the above-described temperature sensing element. The CPU 1901 determines minimum driving conditions for discharging an ink droplet based on temperature information measured by the temperature sensing element 3*d*.

According to the recording head 10*d* illustrated in FIGS. 12A and 12B, the response to a temperature change becomes dull. However, the heater 5 can be configured into a flat shape as the temperature sensing element 3*d* is large. Thus, the ink discharge operation can be stabilized.

The CPU 1901 performs the above-described energy determination processing after completing the recording operation and before starting the next recording operation. For example, in the recording apparatus illustrated in FIG. 13, the energy determination processing is carried out every time the recording of a predetermined number of pages (e.g., 10 pages) is continuously performed.

Alternatively, the energy determination processing can be executed every time the recording of each page is accomplished. It is also possible to execute the energy determination processing in synchronism with preliminary discharge processing which is performed during the recording operation of each page. Furthermore, it is possible to execute the energy determination processing in response to a power-on operation of the recording apparatus.

Furthermore, in determining the driving voltage or the pulse width, it is possible to multiply the required minimum energy value for discharging an ink droplet by a coefficient (e.g., 1.2).

Furthermore, in a recording head for a full-line type recording apparatus that has a length corresponding to the width of a maximum printable sheet, a combination of a plurality of heads can be used to satisfy the length of the recording head. Moreover, the length of the recording head can be realized by an integrally formed recording head.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-118634 filed Apr. 27, 2007, which is hereby incorporated by reference herein in its entirety.

What is claimed is:

1. A method of controlling a recording apparatus including an electrothermal transducer and a temperature sensing element disposed in association with the electrothermal transducer, the method comprising:

supplying energy to the electrothermal transducer and obtaining a temperature change curve from the temperature sensing element;

differentiating the temperature change curve twice with respect to time and obtaining a differential curve; and determining an amount of energy to be supplied to the electrothermal transducer during a recording operation based on the differential curve.

2. The method according to claim 1, wherein the amount of energy is varied by changing a voltage value to be applied to the electrothermal transducer.

3. The method according to claim 1, wherein the amount of energy is varied by changing a driving pulse width to be applied to the electrothermal transducer.

4. The method according to claim 1, wherein, in the obtaining a temperature change curve, plural temperature change curves corresponding to respective amounts of energy are obtained while the amount of energy to be supplied to the electrothermal transducer is reduced, and wherein, in the determining an amount of energy, the amount of energy during a recording operation is determined by comparing plural differential curves to an acceptance criteria, the plural differential curves obtained by differentiating the plural temperature change curves twice with each other.

5. The method according to claim 4, wherein the plural differential curves are compared by comparing the plural differential curves to a presence or absence of a peak.

6. A recording apparatus comprising:

a recording head including an electrothermal transducer and a temperature sensing element disposed in association with the electrothermal transducers;

a temperature curve obtaining unit configured to supply energy to the electrothermal transducer and to a obtain temperature curve from the temperature sensing element;

a differentiating unit configured to differentiate the temperature curve twice with respect to time and to obtain a differential curve; and an energy determination unit configured to determine an amount of energy to be supplied to the electrothermal transducer during a recording operation based on the differential curve.

7. The recording apparatus according to claim 6, wherein each of the temperature sensing elements of the recording head is disposed with respect to an associated electrothermal transducer with an insulating film therebetween.

* * * * *